US009903234B2

(12) United States Patent
Dyer

(10) Patent No.: US 9,903,234 B2
(45) Date of Patent: Feb. 27, 2018

(54) RETENTION PLATE

(71) Applicant: Caterpillar Inc., Peoria, IL (US)

(72) Inventor: David M. Dyer, West Lafayette, IN (US)

(73) Assignee: Catepillar Inc., Peoria, IL (US)

( * ) Notice: Subject to any disclaimer, the term of this patent is extended or adjusted under 35 U.S.C. 154(b) by 150 days.

(21) Appl. No.: 15/082,261

(22) Filed: Mar. 28, 2016

(65) Prior Publication Data

US 2017/0276030 A1 Sep. 28, 2017

(51) Int. Cl.

| | |
|---|---|
| ***F01L 1/18*** | (2006.01) |
| ***F01L 1/24*** | (2006.01) |
| *F01L 1/344* | (2006.01) |

(52) U.S. Cl.

CPC ..... *F01L 1/2411* (2013.01); *F01L 1/18* (2013.01); *F01L 1/2405* (2013.01); *F01L 1/2422* (2013.01); *F01L 1/344* (2013.01)

(58) Field of Classification Search

CPC ..... F01L 1/18; F01L 1/2405; F01L 1/2411; F01L 1/2422

USPC ..... 123/90.39, 90.44, 90.45, 90.46

See application file for complete search history.

(56) References Cited

U.S. PATENT DOCUMENTS

| | | | | |
|---|---|---|---|---|
| 4,509,467 | A | 4/1985 | Arai et al. | |
| 4,589,384 | A | 5/1986 | Ott | |
| 5,035,209 | A | 7/1991 | Braker et al. | |
| 5,546,899 | A | 8/1996 | Sperling et al. | |
| 6,418,894 | B1 | 7/2002 | Haas et al. | |
| 6,978,752 | B2 | 12/2005 | Albertson et al. | |
| 7,275,507 | B2 | 10/2007 | Keller et al. | |
| 7,350,492 | B2 | 4/2008 | Barth et al. | |
| 7,823,555 | B2 | 11/2010 | Bugescu et al. | |
| 9,482,120 | B2 * | 11/2016 | Brune | F01L 1/185 123/90.45 |

* cited by examiner

*Primary Examiner* — Ching Chang

(57) ABSTRACT

A retention plate for a hydraulic lash adjuster of a valve train is provided. The retention plate includes a first surface. The retention plate includes a second surface mutually opposite the first surface. The second surface is adapted to contact with a cylinder head of an engine. The retention plate also includes a coupling mechanism defined on the retention plate. The coupling mechanism is adapted to couple the retention plate to the cylinder head. The coupling mechanism includes a through hole adapted to receive a mechanical fastener therethrough. The retention plate further includes a restriction mechanism defined on the retention plate. The restriction mechanism is adapted to restrict a movement of the hydraulic lash adjuster beyond the first surface towards the cylinder head. The restriction mechanism includes an aperture having an aperture size smaller than an outer diameter of the hydraulic lash adjuster.

20 Claims, 5 Drawing Sheets

RETENTION PLATE

TECHNICAL FIELD

The present disclosure relates to a retention plate. More particularly, the present disclosure relates to the retention plate for a valve train of an engine.

BACKGROUND

Generally, a valve train of an engine employs a pushrod and a hydraulic lash adjuster to transmit motion from a rotary cam to a rocker arm of the valve train. Due to continuous operation, the pushrod may experience loosening or breakage. In such a situation, the pushrod may move from its position and may slip into a cavity of the engine such as within the engine block. As a result, the slipped pushrod may interfere with other parts within the engine causing extreme damage to the engine. For example, the pushrod may slip back into the engine block and damage one or more valves associated with a cooling/lubrication system of the engine. This may lead to coolant/lubrication leakage or contamination, resulting in machine downtime, expensive repairs, and so on.

U.S. Pat. No. 6,978,752 describes a valve lifter guide for use with an internal combustion engine. The valve lifter guide is adapted for maintaining an angular position of a reciprocable valve lifter. The valve lifter includes a circumferential surface with an axially extending alignment flat. The valve lifter guide includes a metal guide body having a longitudinal guide wall. The guide wall includes a guide opening adapted to receive a valve lifter. The valve lifter guide includes a nonmetallic insert extending laterally across the guide wall. The insert is retained by the guide body adjacent a longitudinal end of the guide opening. The insert is positioned to engage the alignment flat of the valve lifter received in the guide opening to substantially maintain the angular position of the valve lifter in the guide.

Currently used guides for the valve train may be unable to restrict slippage of the pushrod within the cavity of the engine in case of a failure thereof. Hence, there is a need for an improved system for controlling slippage of the pushrod into the engine.

SUMMARY OF THE DISCLOSURE

In an aspect of the present disclosure, a retention plate for a hydraulic lash adjuster of a valve train is provided. The retention plate includes a first surface. The retention plate includes a second surface mutually opposite the first surface. The second surface is adapted to contact with a cylinder head of an engine. The retention plate also includes a coupling mechanism defined on the retention plate. The coupling mechanism is adapted to couple the retention plate to the cylinder head. The coupling mechanism includes a through hole adapted to receive a mechanical fastener therethrough. The retention plate further includes a restriction mechanism defined on the retention plate. The restriction mechanism is adapted to restrict a movement of the hydraulic lash adjuster beyond the first surface towards the cylinder head. The restriction mechanism includes an aperture having an aperture size smaller than an outer diameter of the hydraulic lash adjuster.

In another aspect of the present disclosure, a valve train is provided. The valve train includes a valve. The valve train includes a valve spring coupled to the valve. The valve train includes a rocker arm having a first end and a second end.

The first end of the rocker arm is coupled to the valve. The valve train includes a rocker stand pivotally coupled to the rocker arm. The valve train includes an adjustment screw coupled to the second end of the rocker arm. The valve train includes a hydraulic lash adjuster having a first end and a second end. The first end of the hydraulic lash adjuster is coupled to the adjustment screw. The valve train also includes a pushrod coupled to the second end of the hydraulic lash adjuster. The valve train further includes a retention plate. The retention plate includes a first surface. The retention plate includes a second surface mutually opposite the first surface. The second surface is adapted to contact with a cylinder head of an engine. The retention plate also includes a coupling mechanism defined on the retention plate. The coupling mechanism is adapted to couple the retention plate to the cylinder head. The coupling mechanism includes a through hole adapted to receive a mechanical fastener therethrough. The retention plate further includes a restriction mechanism defined on the retention plate. The restriction mechanism is adapted to restrict a movement of the hydraulic lash adjuster beyond the first surface towards the cylinder head. The restriction mechanism includes an aperture having an aperture size smaller than an outer diameter of the hydraulic lash adjuster.

In yet another aspect of the present disclosure, an engine system is provided. The engine system includes an engine block. The engine system includes a cylinder head. The engine system also includes a valve train having a hydraulic lash adjuster. The engine system further includes a retention plate for the hydraulic lash adjuster. The retention plate includes a first surface. The retention plate includes a second surface mutually opposite the first surface. The second surface is adapted to contact with the cylinder head. The retention plate also includes a coupling mechanism defined on the retention plate. The retention plate is coupled to the cylinder head through the coupling mechanism. The retention plate further includes a restriction mechanism defined on the retention plate. The restriction mechanism is adapted to restrict a movement of the hydraulic lash adjuster beyond the first surface towards the cylinder head. The restriction mechanism includes an aperture having an aperture size smaller than an outer diameter of the hydraulic lash adjuster.

Other features and aspects of this disclosure will be apparent from the following description and the accompanying drawings.

DETAILED DESCRIPTION

Figure 1:
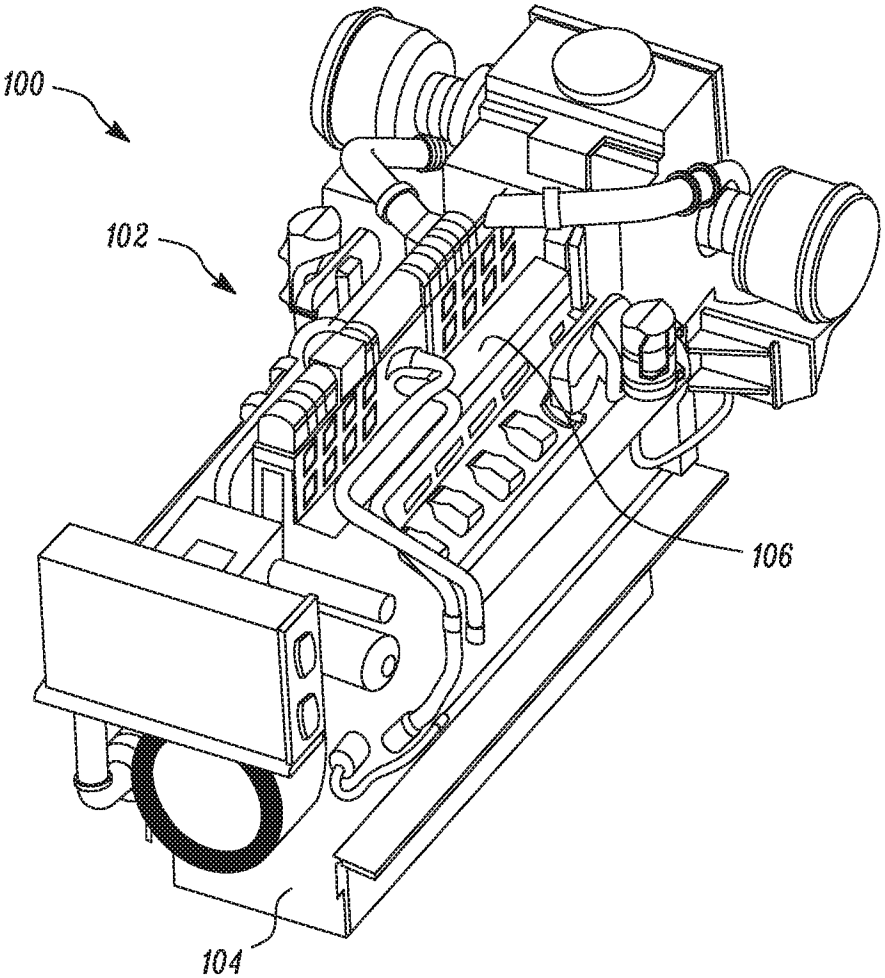
FIG. 1 is a perspective view of an exemplary engine system, according to one embodiment of the present disclosure.

Wherever possible, the same reference numbers will be used throughout the drawings to refer to the same or the like parts. Referring to FIG. 1, an exemplary engine system 100 is illustrated. The engine system 100 includes an internal combustion engine 102 powered by any fuel known in the art such as gasoline, diesel, natural gas, and so on, or a combination thereof. The engine system 100 may be used for applications including, but not limited to, power generation, transportation, construction, agriculture, forestry, aviation, marine, material handling, and waste management.

The engine system 100 includes an engine block 104. The engine block 104 includes one or more cylinders (not shown) provided therein. The cylinders may be arranged in any configuration such as inline, radial, "V", and so on. The engine system 100 also includes a cylinder head 106 mounted on the engine block 104. The cylinder head 106 is adapted to house one or more components and/or systems (not shown) of the engine system 100 such as a valve train, an intake manifold, an exhaust manifold, sensors, and so on. Additionally, the engine system 100 may include various other components and/or systems (not shown) such as a crankcase, a fuel system, an air system, a cooling system, a turbocharger, an exhaust gas recirculation system, an exhaust aftertreatment system, other peripheries, and so on.

Figure 2:
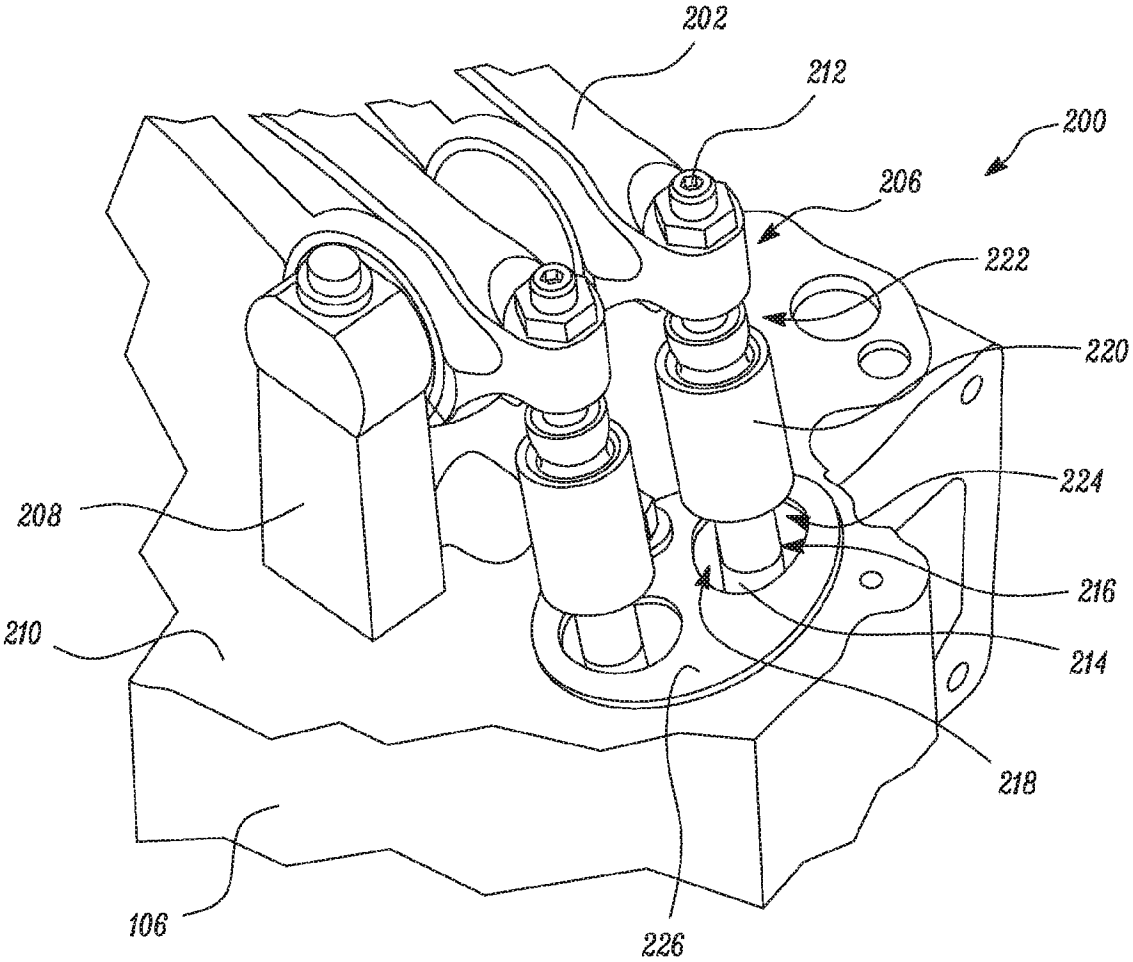
FIG. 2 is a partial perspective view of a valve train of the engine system of FIG. 1 with a retention plate, according to one embodiment of the present disclosure.

Referring to FIG. 2, the engine system 100 includes a valve train 200. The valve train 200 includes a valve (not shown). The valve is provided is association with an inlet port (not shown) or an outlet port (not shown) of the cylinder head 106. The valve is adapted to selectively open or close the inlet port or the outlet port during operation of the engine system 100. The valve train 200 includes a valve spring (not shown) coupled to the valve. The valve spring is adapted to bias the valve in an open position or a closed position based on application requirements.

The valve train 200 includes a rocker arm 202. The rocker arm 202 has a first end (not shown) and a second end 206. The first end of the rocker arm 202 is coupled to the valve through a valve bridge (not shown). The valve train 200 includes a rocker stand 208 provided on a surface 210 of the cylinder head 106. The rocker stand 208 is pivotally coupled to the rocker arm 202. The rocker stand 208 is adapted to support the rocker arm 202 and provide an oscillatory motion to the rocker arm 202. The valve train 200 includes an adjustment screw 212. The adjustment screw 212 is coupled to the second end 206 of the rocker arm 202. The adjustment screw 212 is adapted to adjust a valve clearance based on application requirements.

The valve train 200 also includes a pushrod 214. The pushrod 214 has a first end (not shown) and a second end 216. The first end of the pushrod 214 is operably coupled to a cam (not shown) of the engine system 100. More specifically, the pushrod 214 is received through a slot 218 in the cylinder head 106 for operably coupling the first end of the pushrod 214 with the cam. Accordingly, a size of the slot 218 is larger than an outer diameter of the pushrod 214. Based on a rotation of the cam, the pushrod 214 is adapted to translate in a direction substantially perpendicular to the surface 210 of the cylinder head 106. In the illustrated embodiment, the pushrod 214 is adapted to translate in a vertical direction. In a horizontally oriented engine system 100, the pushrod 214 may be adapted to translate in a horizontal direction based on the rotation of the cam. The second end 216 of the pushrod 214 is coupled to a Hydraulic Lash Adjuster (HLA) 220.

The valve train 200 includes the HLA 220 having a first end 222 and a second end 224. The first end 222 of the HLA 220 is coupled to the adjustment screw 212. In some embodiments, the adjustment screw 212 may be omitted. In such a situation, the first end 222 of the HLA 220 may be coupled to the second end 206 of the rocker arm 202. The second end 224 of the HLA 220 is coupled to the second end 216 of the pushrod 214. The HLA 220 is adapted to maintain a required valve clearance such as a zero valve clearance based on application requirements. The HLA 220 is also adapted to compensate for thermal expansion and reduce wear and tear of components of the valve train 200. The HLA 220 may be any lash adjuster known in the art such as a piston cylinder based lash adjuster, a spring based lash adjuster, and so on. The HLA 220 has an outer diameter larger than the outer diameter of the pushrod 214.

The present disclosure relates to a retention plate 226 provided in association with the valve train 200. The retention plate 226 is provided on the surface 210 of the cylinder head 106 and adjacent to the slot 218 of the cylinder head 106. The retention plate 226 may be made of any metal known in the art such as, for example, steel. The retention plate 226 may be made by any known manufacturing process such as forging, casting, joining, and so on.

Figure 3:
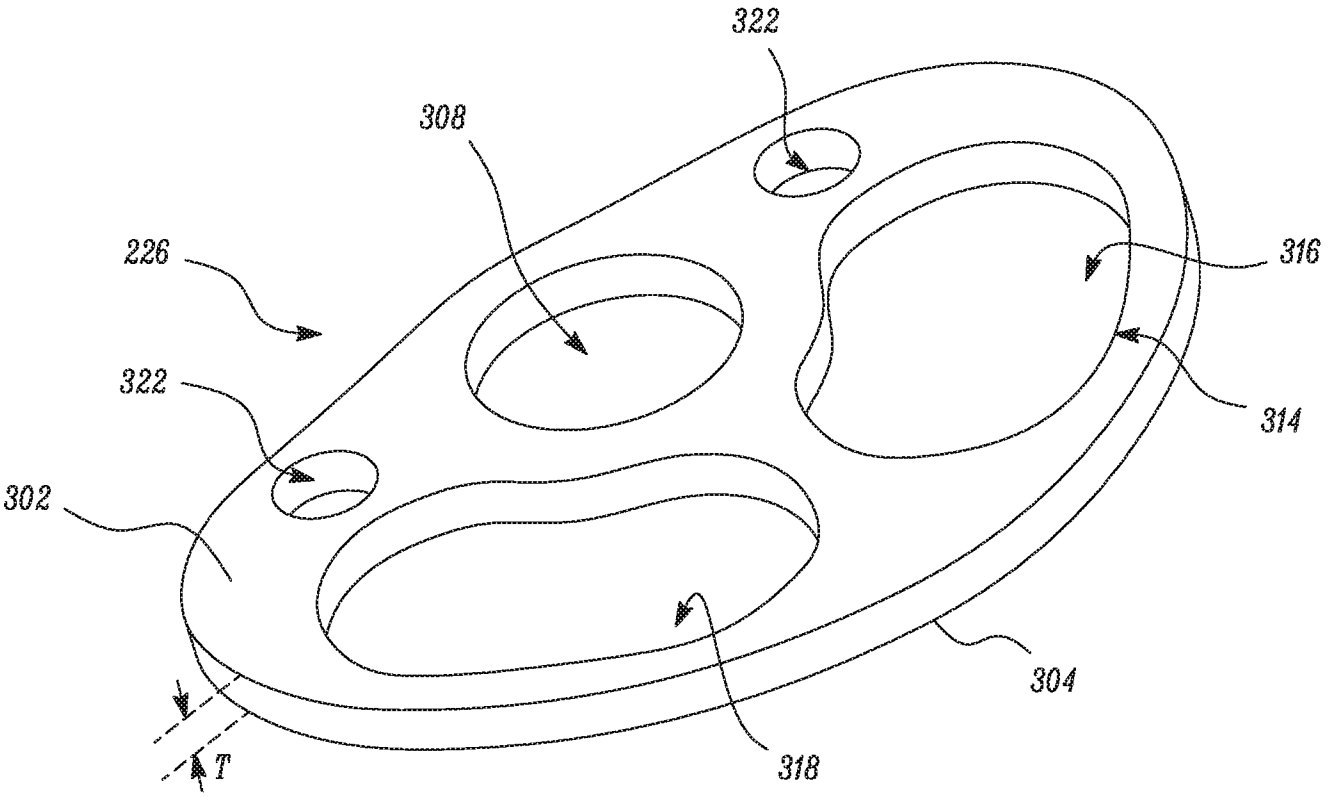
FIG. 3 is a perspective view of the retention plate of FIG. 2, according to one embodiment of the present disclosure.

Referring to FIG. 3, the retention plate 226 has a flat, planar, and substantially oval configuration. The retention plate 226 has a first surface 302. The retention plate 226 also has a second surface 304. The second surface 304 is mutually opposite the first surface 302. Further, the first surface 302 and the second surface 304 are spaced apart from one another defining a thickness "T" of the retention plate 226. The second surface 304 is adapted to contact with the surface 210 of the cylinder head 106 (see FIG. 2).

The retention plate 226 includes a coupling mechanism defined thereon. The coupling mechanism is adapted to couple the retention plate 226 to the cylinder head 106. More specifically, the coupling mechanism includes a through hole 308. The through hole 308 is adapted to receive a mechanical fastener 408 (see FIG. 4) therethrough. In the illustrated embodiment, the mechanical fastener 408 is a head bolt adapted to couple the cylinder head 106 with the engine block 104. In other embodiments, the mechanical fastener 408 may be any other bolt different from the head bolt, a screw, a rivet, and so on adapted to couple the retention plate 226 to the cylinder head 106. In yet other embodiments, the retention plate 226 may be coupled to the cylinder head 106 by any joining process such as welding, brazing, and so on. It should be noted that number, location, dimension and configuration of the through hole 308 disclosed herein is merely exemplary and does not limit the scope of the disclosure.

The retention plate 226 also includes a restriction mechanism defined thereon. The restriction mechanism is adapted to restrict a movement of the HLA 220 beyond the first surface 302 of the retention plate 226 towards the cylinder head 106. The restriction mechanism includes an aperture 314. The aperture 314 is adapted to receive the pushrod 214 therethrough. Accordingly, an aperture size of the aperture 314 is larger than the outer diameter of the pushrod 214. The aperture 314 is shaped to conform to the outer diameter of the pushrod 214.

Further, the aperture size of the aperture 314 is smaller than the outer diameter of the HLA 220 in order to restrict the movement of the HLA 220 beyond the first surface 302 of the retention plate 226 towards the cylinder head 106. More specifically, during operation of the engine system 100, when the pushrod 214 and in turn the HLA 220 may move toward the cylinder head 106, the second end 224 of the HLA 220 may contact the first surface 302 of the retention plate 226. Since the aperture size of the aperture 314 is smaller than the outer diameter of the HLA 220, the first surface 302 of the retention plate 226 may present itself as an obstruction preventing the HLA 220 from moving towards or into the cylinder head 106. As a result, the movement of the HLA 220 and in turn the pushrod 214 is restricted beyond the first surface 302 of the retention plate 226.

Also, the thickness "T" of the retention plate 226 is selected in a manner such that the thickness "T" is lesser than a distance between the surface 210 of the cylinder head 106 and the second end 224 of the HLA 220. As a result, during normal operation of the valve train 200 and the translatory motion of the HLA 220, the second end 224 of the HLA 220 may not contact with the first surface 302 of the retention plate 226. More specifically, the second end 224 of the HLA 220 may contact the first surface 302 of the retention plate 226 and may be restricted thereby only when the HLA 220 may move toward the cylinder head 106 due to excessive movement in the system.

In the illustrated embodiment, the restriction mechanism includes a first aperture 316 and a second aperture 318. In other embodiments, the restriction mechanism may include a single aperture or multiple apertures based on application requirements. Each of the first aperture 316 and the second aperture 318 is adapted to receive a separate pushrod 214 of the valve train 200 of the engine system 100. The first aperture 316 is positioned adjacent to the second aperture 318. Also, the first aperture 316 and the second aperture 318 are equidistant from the through hole 308. It should be noted that number, location, dimension and configuration of the aperture 314, the first aperture 316 and/or the second aperture 318 disclosed herein is merely exemplary and may not limit the scope of the disclosure.

Additionally, the retention plate 226 includes a fixation mechanism. The fixation mechanism includes a pair of openings 322. Each of the pair of openings 322 is positioned on either sides of the through hole 308. Also, a diameter of the through hole 308 is at least twice a diameter of each of the pair of openings 322. Each of the pair of openings 322 is adapted to receive a mechanical fastener therein such as a secondary pin 406 (see FIG. 4) of a fixture 402 (see FIG. 4). More specifically, during assembly of the retention plate 226, the fixture 402 is provided to align and hold the retention plate 226 in place. It should be noted that number, location, dimension and configuration of the openings 322 disclosed herein is merely exemplary and may not limit the scope of the disclosure.

Figure 4:
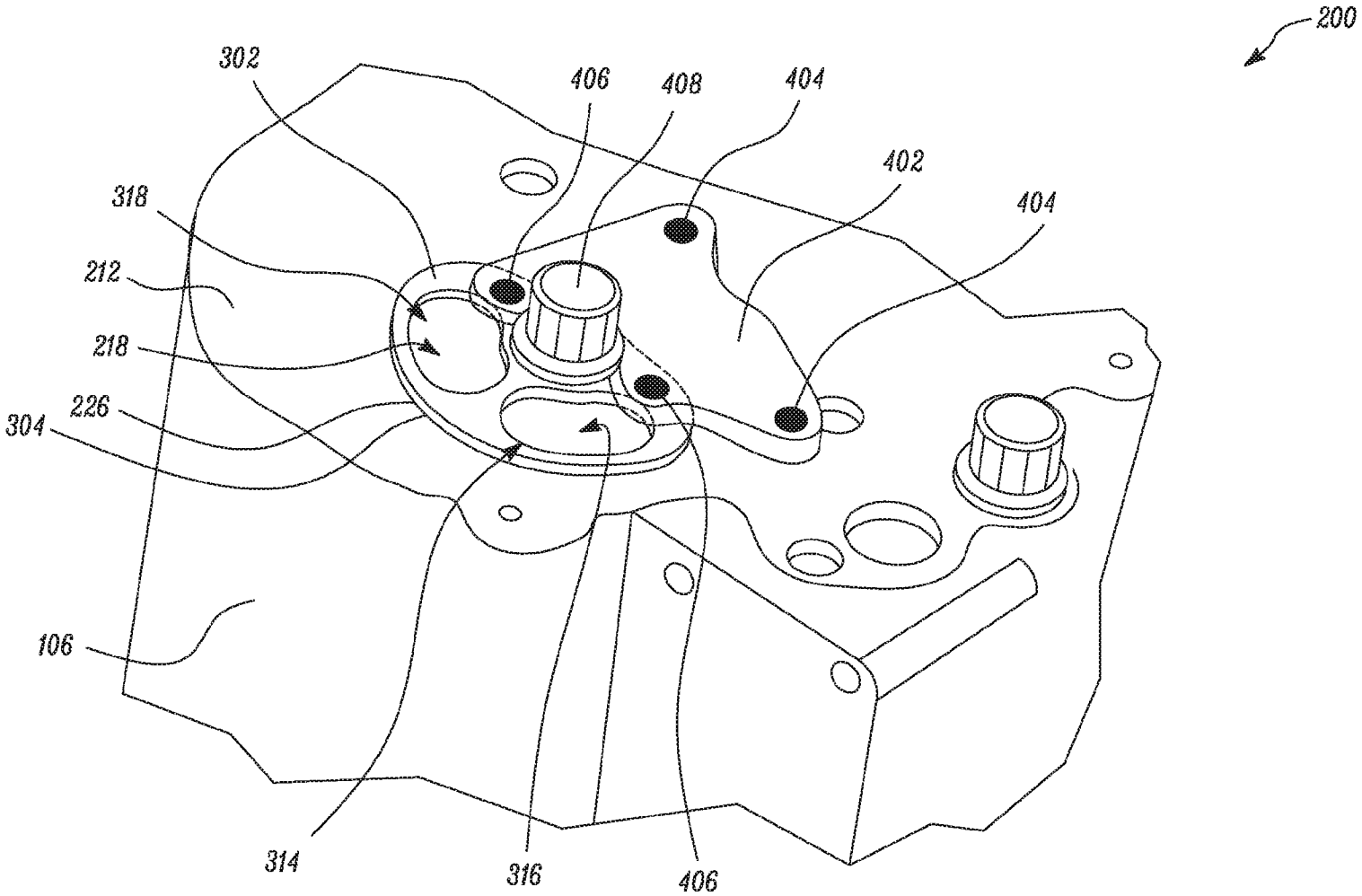
FIG. 4 is a perspective view of the retention plate of FIG. 3 and a fixture, according to one embodiment of the present disclosure.

Referring to FIG. 4, the fixture 402 includes one or more primary pins 404. Each of the primary pins 404 is adapted to be received into an alignment hole (not shown) provided on the surface 210 of the cylinder head 106. The alignment holes and the primary pins 404 are adapted to align the fixture 402 on the surface 210 of the cylinder head 106 with respect to the slot 218 of the cylinder head 106. The fixture 402 also includes one or more secondary pins 406. Each of the secondary pins 406 is adapted to be received into each of the pair of openings 322 of the fixation mechanism provided on the retention plate 226.

The secondary pins 406 are adapted to align the retention plate 226 with respect to the fixture 402 and the slot 218. More specifically, the retention plate 226 is aligned such that the first aperture 316 and the second aperture 318 are coaxially aligned with respect to the slot 218 of the cylinder head 106. The secondary pins 406 are also adapted to hold the retention plate 226 in place during assembly.

During assembly of the retention plate 226, the fixture 402 is provided on the cylinder head 106 to correctly align the retention plate 226 with respect to the slot 218 of the cylinder head 106. The primary pins 404 of the fixture 402 are then received in the alignment holes of the cylinder head 106. As a result, the fixture 402 may then by aligned with respect to the cylinder head 106. Further, the secondary pins 406 are received into the pair of openings 322 provided on the retention plate 226. As a result, the retention plate 226 may be aligned with respect to the fixture 402 and the slot 218 of the cylinder head 106. More specifically, the first aperture 316 and the second aperture 318 are coaxially aligned with respect to the slot 218 of the cylinder head 106. The mechanical fastener 408 is then provided in the through hole 308 and torqued to couple the retention plate 226 with the cylinder head 106. During the torquing, the fixture 402 holds the retention plate 226 in place and restricts movement of the retention plate 226. Once assembled, the fixture 402 is released from the cylinder head 106.

Figure 5:
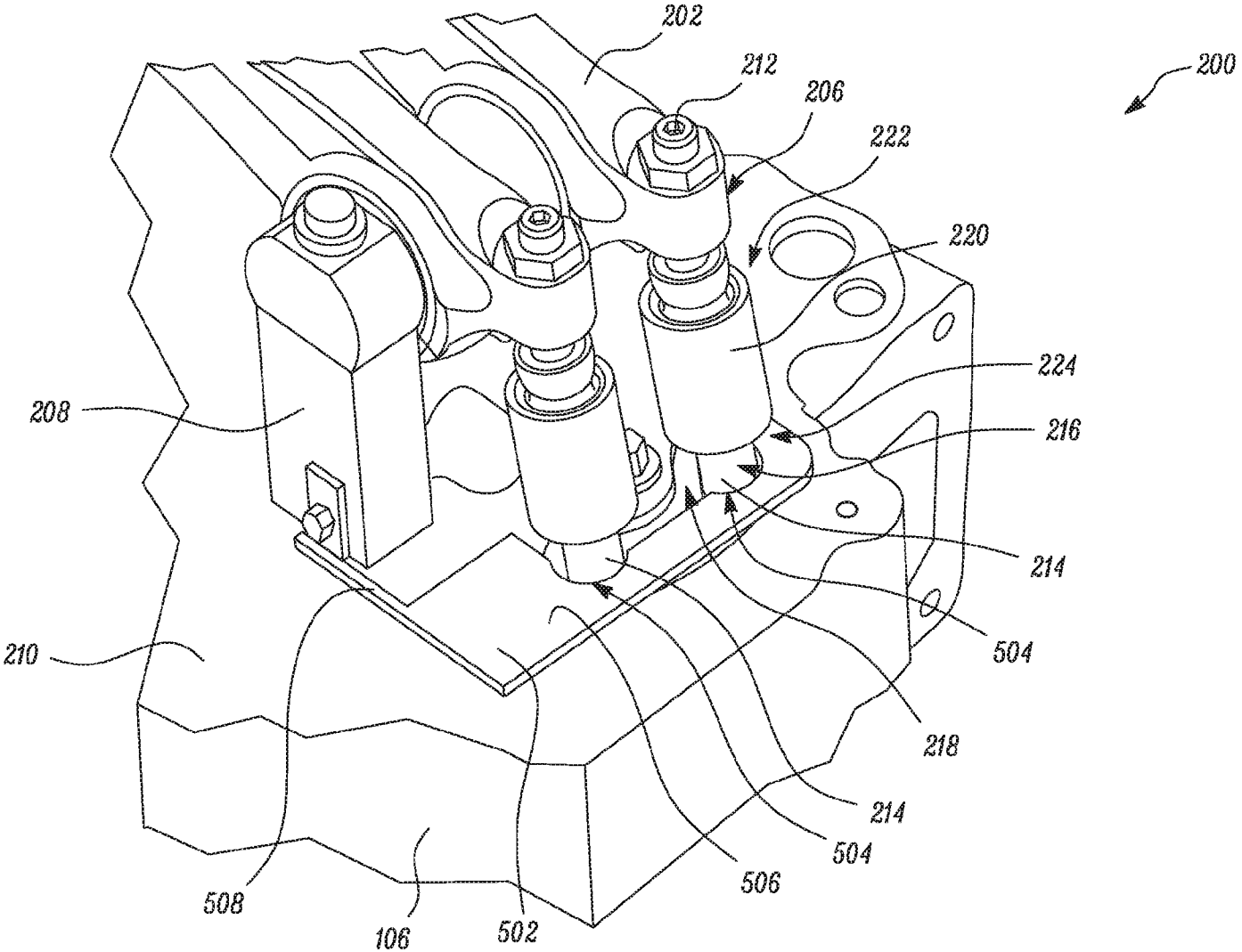
FIG. 5 is a partial perspective view of the valve train of the engine system of FIG. 1 with a retention plate, according to another embodiment of the present disclosure.

Referring to FIG. 5, another embodiment of a retention plate 502 is illustrated. The retention plate 502 includes one or more cutouts 504. The retention plate 502 is provided on the surface 210 of the cylinder head 106 in a manner such that the cutouts 504 align with the slot 218 of the cylinder head 106. The cutouts 504 are adapted to receive the pushrod 214 therethrough. Accordingly, a size of the cutouts 504 is larger than the outer diameter of the pushrod 214. Also, the size of the cutouts 504 is smaller than the outer diameter of the HLA 220. During the movement of the HLA 220 toward the cylinder head 106, the second end 224 of the HLA 220 may contact the first surface 506 of the retention plate 502 and restrict further movement of the HLA 220 and the pushrod 214 toward the cylinder head 106. The retention plate 502 also includes one or more arms 508. In the illustrated embodiment, the arms 508 are adapted to couple the retention plate 502 with the rocker stand 208. In other embodiments, the arms 508 may be adapted to couple the retention plate 502 with the cylinder head 106 or any other component of the engine system 100 based on application requirements.

INDUSTRIAL APPLICABILITY

The present disclosure relates to the retention plate 226, 502 adapted to restrict the movement of the HLA 220 beyond the first surface 302 of the retention plate 226, 502. In situations such as a loosened or broken pushrod 214, the design of the retention plate 226, 502 is such that the second end 224 of the HLA 220 may contact with the first surface 302 of the retention plate 226, 502, thereby restricting the HLA 220 from further moving into the slot 218 and the engine block 104. Further, during complete detachment of the pushrod 214 from the cam and/or the HLA 220 from the adjustment screw 212 or the second end 206 of the rocker arm 202, the pushrod 214 and the HLA 220 may move towards the cylinder head 106. As a result, the second end 224 of the HLA 220 may contact and rest on the first surface 302 of the retention plate 226, 502. This may restrict further slipping of the pushrod 214 and the HLA 220 within the engine block 104 and the HLA 220 may be retained above the cylinder head 106.

In situations when the head bolt is used to couple the retention plate 226,502 to the cylinder head 106, the retention plate 226, 502 additionally serves as a washer for the head bolt eliminating a need for a separate washer. Due to a configuration of the retention plate 226, 502, the retention plate 226, 502 may be coupled to the cylinder head 106 without any major modifications to the existing valve train 200 and/or the cylinder head 106.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A retention plate for a hydraulic lash adjuster of a valve train, the retention plate comprising:

a first surface;

a second surface mutually opposite the first surface, the second surface adapted to contact with a cylinder head of an engine;

a coupling mechanism defined on the retention plate, the coupling mechanism adapted to couple the retention plate to the cylinder head, wherein the coupling mechanism includes a through hole adapted to receive a mechanical fastener therethrough; and a restriction mechanism defined on the retention plate, the restriction mechanism adapted to restrict a movement of the hydraulic lash adjuster beyond the first surface towards the cylinder head, wherein the restriction mechanism includes an aperture having an aperture size smaller than an outer diameter of the hydraulic lash adjuster.

2. The retention plate of claim 1 further comprising a fixation mechanism including a pair of openings adapted to receive mechanical fasteners therethrough.

3. The retention plate of claim 2, wherein each of the pair of the openings is positioned on either sides of the through hole.

4. The retention plate of claim 2, wherein a diameter of the through hole is at least twice a diameter of each of the pair of openings.

5. The retention plate of claim 1, wherein the restriction mechanism includes a first aperture and a second aperture such that the second aperture is positioned adjacent to the first aperture.

6. The retention plate of claim 5, wherein the first aperture and the second aperture are equidistant from the through hole.

7. The retention plate of claim 1, wherein the retention plate is made of a metal.

8. A valve train comprising:

a valve;

a valve spring coupled to the valve;

a rocker arm having a first end and a second end, the first end of the rocker arm coupled to the valve;

a rocker stand pivotally coupled to the rocker arm;

an adjustment screw coupled to the second end of the rocker arm;

a hydraulic lash adjuster having a first end and a second end, the first end of the hydraulic lash adjuster coupled to the adjustment screw;

a pushrod coupled to the second end of the hydraulic lash adjuster; and a retention plate comprising:

a first surface;

a second surface mutually opposite the first surface, the second surface adapted to contact with a cylinder head of an engine;

a coupling mechanism defined on the retention plate, the coupling mechanism adapted to couple the retention plate to the cylinder head, wherein the coupling mechanism includes a through hole adapted to receive a mechanical fastener therethrough; and a restriction mechanism defined on the retention plate, the restriction mechanism adapted to restrict a movement of the hydraulic lash adjuster beyond the first surface towards the cylinder head, wherein the restriction mechanism includes an aperture having an aperture size smaller than an outer diameter of the hydraulic lash adjuster.

9. The valve train of claim 8 further comprising a fixation mechanism including a pair of openings adapted to receive mechanical fasteners therethrough.

10. The valve train of claim 9, wherein each of the pair of the openings is positioned on either sides of the through hole.

11. The valve train of claim 9, wherein a diameter of the through hole is at least twice a diameter of each of the pair of openings.

12. The valve train of claim 8, wherein the restriction mechanism includes a first aperture and a second aperture such that the second aperture is positioned adjacent to the first aperture.

13. The valve train of claim 12, wherein the first aperture and the second aperture are equidistant from the through hole.

14. An engine system comprising:

an engine block;

a cylinder head;

a valve train having a hydraulic lash adjuster;

a retention plate for the hydraulic lash adjuster, the retention plate comprising:

a first surface;

a second surface mutually opposite the first surface, the second surface adapted to contact with the cylinder head;

a coupling mechanism defined on the retention plate, wherein the retention plate is coupled to the cylinder head through the coupling mechanism; and a restriction mechanism defined on the retention plate, the restriction mechanism adapted to restrict a movement of the hydraulic lash adjuster beyond the first surface towards the cylinder head, wherein the restriction mechanism includes an aperture having an aperture size smaller than an outer diameter of the hydraulic lash adjuster.

15. The engine system of claim 14, wherein the coupling mechanism includes a through hole adapted to receive a mechanical fastener therethrough.

16. The engine system of claim 15, wherein the retention plate further comprises a fixation mechanism including a pair of openings adapted to receive mechanical fasteners therethrough.

17. The engine system of claim 16, wherein each of the pair of the openings is positioned on either sides of the through hole.

18. The engine system of claim 16, wherein a diameter of the through hole is at least twice a diameter of each of the pair of openings.

19. The engine system of claim 15, wherein the restriction mechanism includes a first aperture and a second aperture such that the second aperture is positioned adjacent to the first aperture.

20. The engine system of claim 19, wherein the first aperture and the second aperture are equidistant from the through hole.

* * * * *